United States Patent [19]

Irvine et al.

[11] 4,083,555

[45] Apr. 11, 1978

[54] SHEET-MATERIAL SEPARATOR AND FEEDER SYSTEM

[75] Inventors: Robert Irvine, Riverside; Harry E. Luperti, Wilton, both of Conn.

[73] Assignee: Pitney-Bowes, Inc., Stamford, Conn.

[21] Appl. No.: 786,188

[22] Filed: Apr. 11, 1977

[51] Int. Cl.[2] ..... B65H 3/52

[52] U.S. Cl. ..... 271/10; 271/111; 271/116; 271/125

[58] Field of Search ..... 271/10, 111, 116, 121, 271/122, 124, 125

[56] References Cited

U.S. PATENT DOCUMENTS

| | | | |
|---|---|---|---|
| 4,030,722 | 6/1977 | Irvine | 271/116 X |
| 4,030,723 | 6/1977 | Irvine | 271/116 X |

*Primary Examiner*—Richard A. Schacher

*Attorney, Agent, or Firm*—Robert S. Salzman; William D. Soltow, Jr.; Albert W. Scribner

[57] ABSTRACT

A high speed sheet-material separating and feeder system is disclosed which handles a wide range of mixed thicknesses and sizes of envelopes and sheets. The sheets are stacked at one end of the system, and are fed to a dual separator mechanism having two separator members. The dual separator mechanism has a first separator member which is adjusted for thicker sheets of the range, and a second separator member which is adjusted for thinner sheets of the range. Sheets leaving the dual separator are ejected one at a time, in seriatim, where they then can be fed to other sheet handling equipment for processing.

5 Claims, 8 Drawing Figures

SHEET-MATERIAL SEPARATOR AND FEEDER SYSTEM

The invention pertains to sheet-handling equipment, and more particularly to a sheet-material separator and feeder system.

BACKGROUND OF THE INVENTION

At present, there is an ever increasing need for machinery that can handle mixed mail, envelopes, and other varying sheet-like material at high speed. Heretofore, machinery designed to process large amounts of mixed mail at high speed has been always limited ot a narrow range of envelope thicknesses and sizes. This was due to the fact that there is no known separators and feeders that can automatically deliver separated mixed sheet outside of a very limited range. Separators that are adjustable for thicker sheet will not function properly for thinner materials and vice versa. Therefore, if a wide range of material is fed into these devices, double feeds, jams, and other unacceptable conditions, will result. Clearly, there exists a need for an automatic (no adjustment) separating and feeding system that will provide a high speed steady stream of mixed material. The present invention addressed itself to this requirement.

RELATED APPLICATIONS

This invention is an improvement over two previously filed copending applications, now U.S. Pat. Nos. 4,030,722 and 4,030,723.

SUMMARY OF THE INVENTION

The invention is for a sheet-material separating and feeding system for handling a wide range of sheet thicknesses and sizes at high speed. The system does not require on-going adjustments or a pre-sorting of materials.

The inventive separator and feeder system comprises a novel dual separating mechanism having a pair of separate members acting in a cooperating, synergistic manner with a drive roller to automatically separate and feed letters of varying thicknesses. The system can handle all thicknesses of mail from postcard or airmail up to ½ inch thick letters.

At the beginning of the system is a stacker where the mixed mail or sheet-material is supported. A feed roller picks off one or more letters from the stack of mail and feeds them to the dual pair of separators. The first separator member of the pair is set to handle the thicker envelopes at the ½ inch end of the thickness range. The second separator member is adjusted to process the thinner envelopes of the range such as airmail letters and postcards. The dual separator mechanism is an improvement over the previously filed inventive separator mechanisms shown in U.S. Pat. Nos. 4,030,722 and 4,030,723 because of a shorter and more compact feed path, and the reduction of parts. Downstream from the dual separator mechanism is a pair of ejection rollers for feeding the sheet material to another downstream device.

A synergistic effect is obtained from the separators by means of clutching. The feed roller and the separator drive roller are clutch controlled. Photosensors are located slightly downstream of the dual separator and the ejection rollers to control the clutch mechanisms. The photosensor associated with the dual separator controls the feed roller clutch. When a piece of mail exits the dual separator, the leading edge of the mail blocks the photosensor. A signal is sent to the feed roller clutch to disengage, so that additional pieces of mail will not be sent to the separator. When the trailing edge of the letter is sensed, the feed roller is once again engaged. The engaging and disengaging of the feed roller is responsive to the discharge of the separator, and allows for a more effective separation and feeding of the mail.

Similarly the photosensor associated with the ejection rollers controls the separator drive roller clutch and the feed roller clutch in a like manner. The feed roller and separator drive roller will not feed until a piece of mail occupying the ejection roller position is completely discharged (the trailing edge is sensed).

The sensing and clutching of the separator drive roller and feed roller provides a "traffic or flow control" to the separator unit. The cooperation between separator and the various drive and feed rollers provides a synergistic effect due to the flow control interrelationships between them.

The separator and feeder system of this invention can be run in two different modes:

(a) free running; or (b) demand feed.

In the free running mode, the separator unit is not controlled by any downstream mail-handling machinery. Mail is discharged one unit at a time, in seriatim, as fast as the separator and feeder system is allowed to run. This mode can provide increased throughput by having the photosensor at the separator station restart the feed roller as the trailing edge of the sheet passes it to reestablish receipt of the light beam.

In the demand feed mode, the separator is clutch controlled, and receives a feed signal from mail-handling machinery located downstream.

In either mode, the separator and feeder system of this invention will deliver mixed sheet-material, envelopes, letters or mail, in a one-at-a-time, seriatim fashion. There should never be any doubles or multiple feeds when the inventive separator and feeder system is working properly.

It is an object of the present invention to provide an improved separating and feeding system;

It is another object of this invention to provide a separating and feeder system that will handle a wide range of sheet thicknesses and sizes; and It is still another object of the inventive separating and feeding system to deliver inter-mixed sheet-material at high speed, one at a time, in seriatim, which will have a shorter feed path (be more compact) and require less parts.

These and other objects of this invention will be better understood and will become more apparent with reference to the following detailed description taken in conjunction with the attached drawings, in which.

Figure 1:
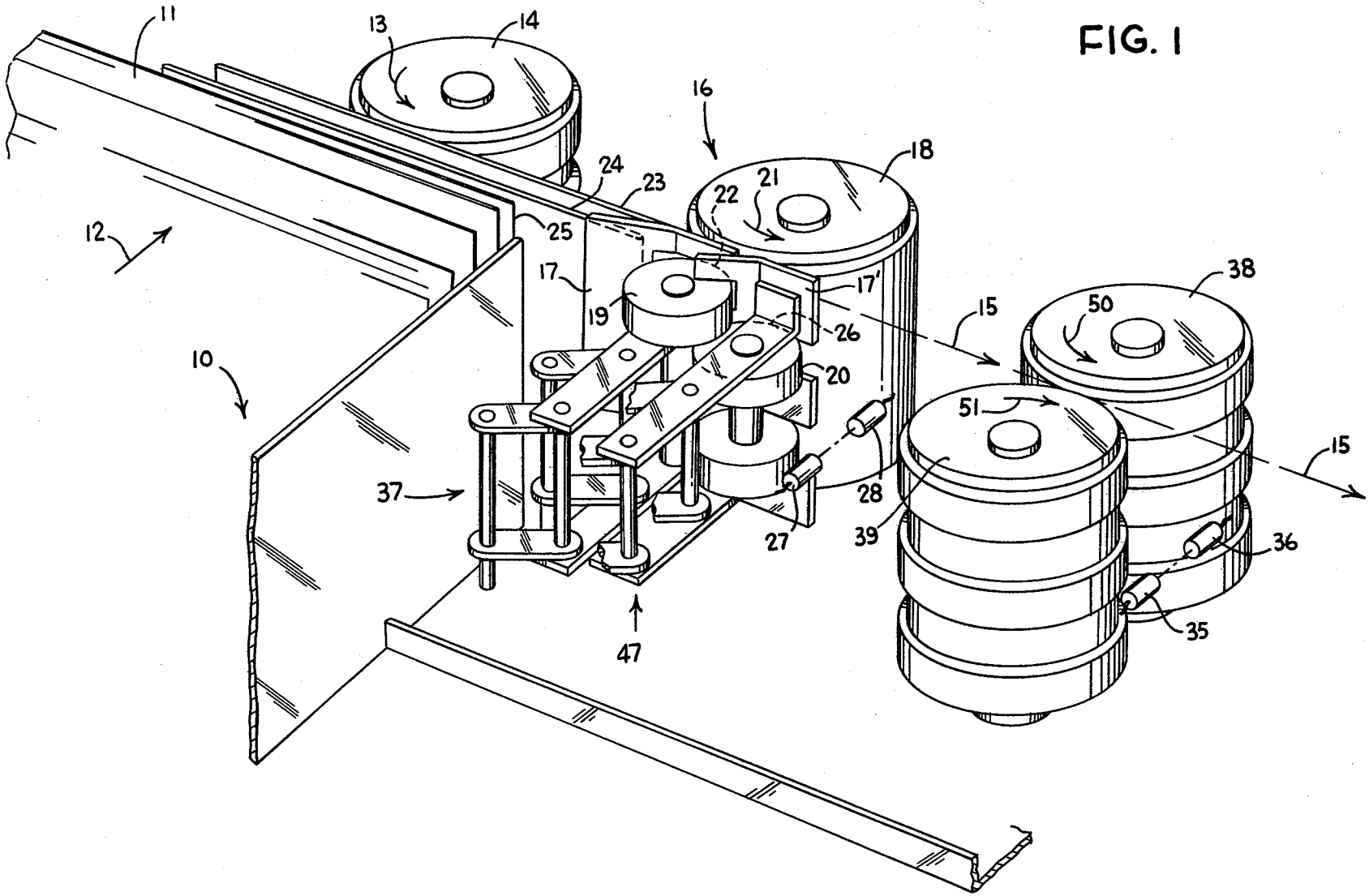
FIG. 1 is a perspective view of the separating and feeding system of this invention.

FIGS. 4*a* through 4*e* are top view schematic views of the operation of the system shown in FIG. 1.

Generally speaking, the invention is for a separating and feeding system for sheet-like materials, envelopes, letters and pieces of mail. The system is designed to handle a wide range of thicknesses of sheet, and deliver the sheet in seriatim to a sheet-handling device. The system comprises a stacking means, which is located at the beginning of a feed path for the sheet. A feeding means is disposed adjacent the stacking means and feeds one or several pieces of sheet from the stacking means. These sheets are fed to a dual separating means disposed along the feed path downstream from the stacking means. This separating means has two separating elements, a first separating member which is adjusted to separate thicker sheets of the range of thicknesses of the sheets; and a second separating member which is adjusted to separate the thinner sheets of the range of sheet thicknesses. Thicker sheets will be forced through the thinly adjusted separating member, however, so that the full range of thicknesses will be separated. The first and second separating members are positioned about the same drive roller and act cooperatively to deliver one sheet at a time in seriatim. The cooperation between the separating means is provided by a traffic control means, which monitors and controls the flow of sheets through the system.

Figure 2:
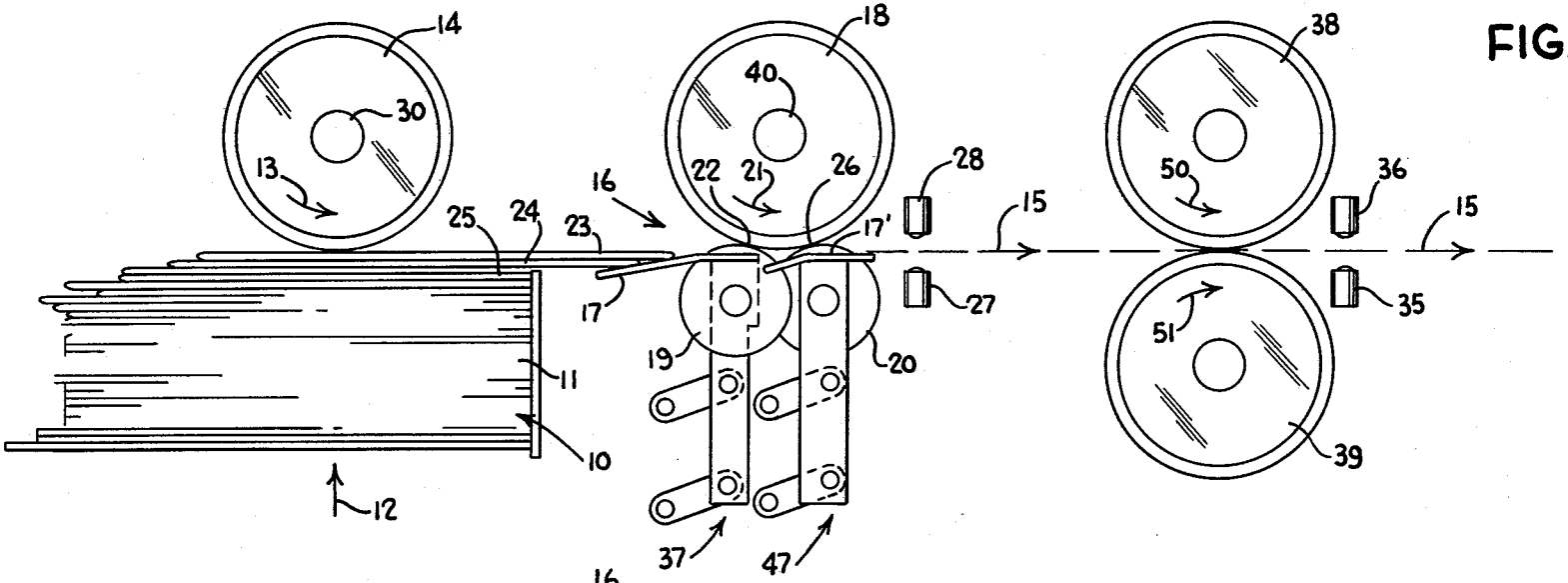
FIG. 2 is a plan view of the invention of FIG. 1.

Now referring to FIGS. 1 and 2, a stacker 10 is shown for supporting and guiding a quantity of mixed mail 11. The mail 11 varies in thickness from postcard or airmail thicknesses up to ½ inch. The size of the envelopes vary from 3½ × 6 inches up to 10 × 13 inches. The letters are fed (arrow 12) towards a forward rotating (arrow 13) feed roller 14, where they are frictionally "picked-off."

The feed roller 14 starts the mail along a feed path generally shown by arrows 15. The feed roller may shingle one or more letters from the pack 11. These letters are urged towards a dual separating station shown generally by arrow 16. The separator station comprises a dual fence 17 and 17', each of which is angled in such a way so as to direct pieces of mail towards the bites of roller 18 and retarding elements 19 and 20, respectively. Roller 18 is a forward rotating roller (arrow 21) that frictionally engages with envelopes caught in the bite of the retarding members and directs the letters forward. The retarder 19 is a retarding member that frictionally engages with envelopes caught in the bite between the roller 18 and the retarding element 19. This retarder 19 tends to separate and retard multiple letters from going through the bite 22. Roller 18 has a high coefficient of friction with respect to paper of approximately 1.3 or greater, which will positively drive pieces of mail forward. Retarder 19, on the other hand, has a coefficient of friction approximately between 0.5 to 0.8, which is greater than that of paper to paper, but less than the feed roller to paper. Thus, if multiple pieces of mail enter the bite 22, the envelope 23 nearest drive roller 18 will be forced forward, and letter 24, 25, etc., will be retarded from forward movement. Retarding roller 19 is stationary, but can be given a reverse rotation in certain applications.

Letters 23, 24, and 25 will normally tend to move together as a unit mass. This is due to the pack pressure of the stack, which creates a frictional drag on each contiguous piece of mail. The retarding roller 19, however, has a greater frictional engagement with these letters, and will retard the multiple pieces of mail from moving forwards. Only letter 23 (letter nearest roller 18) will tend to move forward, because of the higher engaging friction of roller 18.

Figure 3:
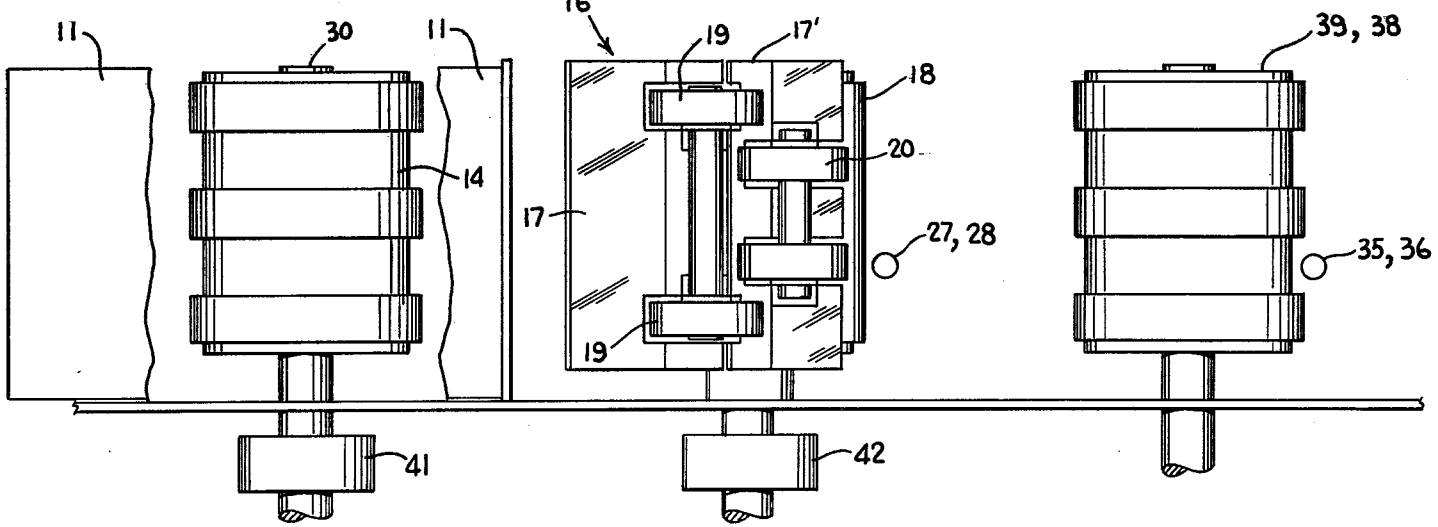
FIG. 3 is a frontal view of the inventive system shown in FIG. 2.

The separator roller pair 19 and 20 are interdigitated as shown in FIGS. 1, 2 and 3, so as to provide a positive intermeshing bite. A positive bite is also provided between drive roller 18 and these retarding rollers by spring loading the retarding rollers 19 and 20 towards roller 18. This biasing also achieves the normal force which causes the drive (See FIGS. 4*a* through 4*e*).

The separator roller 18 and retarding member 19 of station 16 has a bite 22 that is adjusted for letters in the upper end of the thickness range (½-inch end). A lesser engaging bite is useful, since the cooperating driving force of feed roller 14 is diminished due to the drag created by the stack pressure. The low-biased bite 22 aids in the entry of thicker pieces of mail to the separator.

The envelopes pushing past the first separating member 19 enter the second separating member 20. Retarding member 20 has the same coefficient of friction as retarding member 19.

The bite 26 between roller 18 and retarding member 20 is set for thinner letters of the thickness range such as airmail letters or postcards.

Adjustment linkages 37 and 47 are schematically shown in FIGS. 1 and 2. Linkage 37 is used to adjust the gap of separator rollers 18 and 19, and linkage 47 sets the gap for separator rollers 18 and 20.

While the second separator member 20 has rollers which are adjusted for thin pieces of mail, thicker envelopes are able to get through. This is so, because the drive roller 18 and the feed roller 14 both add a forward force to the sheet material.

Pieces of mail leaving the second separator member 20 will be discharged one at a time in seriatim to another mail-handling machine such as a facer-canceller. Ejection rollers 38 and 39 represent the intake of this machine. Both rollers are shown rotating in a forward direction (arrows 50 and 51, respectively).

The feed roller 14 and separator roller 18 are controlled by clutches 41 and 42, respectively, as shown in FIG. 3. These clutches rotatively engage and disengage these rollers from driving the pieces of mail along feed path 15. Each clutch is activated and deactivated by a photosensor device, whose light path intersects the feed path 15. Each photosensor unit comprises a light emitting diode (LED), and a phototransistor.

Photosensor elements 27, 28 are shown immediately downstream of the separator station 16 and are used to control the feeder clutch 41 (FIG. 3).

A second photosensor element pair 35, 36 (FIGS. 1 and 3) is shown immediately downstream of the second separator rollers, and is used to actuate clutches 41 and 42 (FIG. 3) controlling the feed roller 14 and the separator roller 18, respectively.

In the "demand feed" mode, clutches 41 and 42 (FIG. 3) controlling the feed roller 14, and the separator roller 18 respectively, can be actuated by photosensor elements 35, 36. Each of the drive rollers 14 and 18 are mounted to their respective shafts by over-running clutches 30 and 40 (FIG. 2), respectively. These over-running clutches allow the mail to be pulled forward by subsequent drive rollers, when any of these rollers are disengaged by their respective driving clutches 41 and 42. If this were not so, when any of the drive rollers 14 and 18 are stopped from rotating, they would retard the forward progress of the letters in their bite.

OPERATION OF THE INVENTION

As aforementioned, a stack of inter-mixed mail or sheet material is introduced to feed roller 14 from the stacker 10. The feed roller 14 shingles the envelopes in feeding them to a separator station 16. When an envelope is discharged from the separator station 16, the leading edge of the letter will break the light path between the photosensor elements 27 and 28. When this occurs, clutch 41 (FIG. 3) controlling feed roller 14 is deactivated by a signal from the photosensor. The feed roller 14 will now cease to feed any more pieces of mail to the first separator until the trailing edge of the discharged letter passes the last pair of photosensor elements.

As a letter is discharged from separator station 16, it enters a pair of ejection rollers 38 and 39. As previously mentioned, the dual separators 19 and 20 are each individually adjusted for thicker and thinner pieces of mail, respectively, but separator 20 is able to pass thicker envelopes due to the additional drive force provided by the feed roller 14. When a piece of mail is discharged from ejection rollers 38 and 39, the leading edge of the envelope will break the light path between photosensor elements 35 and 36. A signal is now sent to deactuate clutches 41 and 42 (FIG. 3). Feed roller 14 and separator roller 18 will then cease to drive any mail until the trailing edge of the discharged envelope passes photosensor elements 35 and 36.

In the "free running" mode, pieces of mail will be discharged one at a time in seriatim from the separator station 16. The speed by which the letters are expelled will depend upon the speed of driving rollers 14 and 18. This mode can provide increased throughput by having the photosensor at the separator station restart the feed roller as the trailing edge of the sheet passes it to re-establish receipt of the light beam.

In the "demand feed" mode of operation, all the drive rollers including the separator roller 18 are clutch controlled. The clutches 41 and 42 will rotatively engage and disengage their respective drive rollers depending upon an extraneous signal (or lack of signal) from a contiguous mail-handling device. One way of providing such a signal is shown in FIGS. 1 and 2 by photosensor elements 35 and 36.

When an envelope enters the mail-handling device feed-in rollers (ejection rollers 38 and 39), it is discharged past photosensor elements 35 and 36. The leading edge of the letter will provide a signal to clutches 41 and 42 (FIG. 3) to deactuate these clutches, and rotatively disengage drive rollers 14 and 18. Rollers 14 and 18 will not feed another envelope until the trailing edge of the letter positioned in front of photosensor elements 35 and 36 moves past.

Thus, only one letter at a time will be fed to the mail handling device. The speed at which letters will be discharged can be regulated by the speed of rollers 38 and 39, or other extraneous conditions of the mail-handling device.

The dual separator 16 has the advantage of providing a double retarding force to multiple letters 24 or 25 in the bites 22 and 26, respectively, at the same time that the drive rollers 14 and 18 are advancing the lead envelope 23. This insures a good separation to occur between the envelopes.

The flow pattern for the system will now be described with reference to FIGS. 4*a* through 4*e*.

Figure 4A:
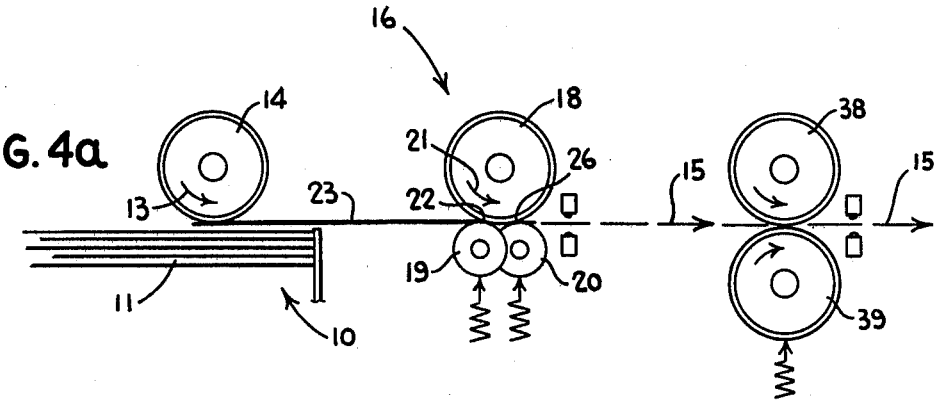

Referring to FIG. 4*a*, a sheet 23 has been fed (arrow 13) from the stack 11 of the stacking device 10 by the feed roller 14. The sheet 23 has entered the bites 22 and 26 of the dual separating mechanism 16. At this stage in the flow pattern of the apparatus, both the feed roller 14 and the drive roller 18 are acting to propel the sheet 23 forward (arrow 15), while retarding members 19 and 20 act to impede the forward movement of any doubled sheets.

Figure 4B:
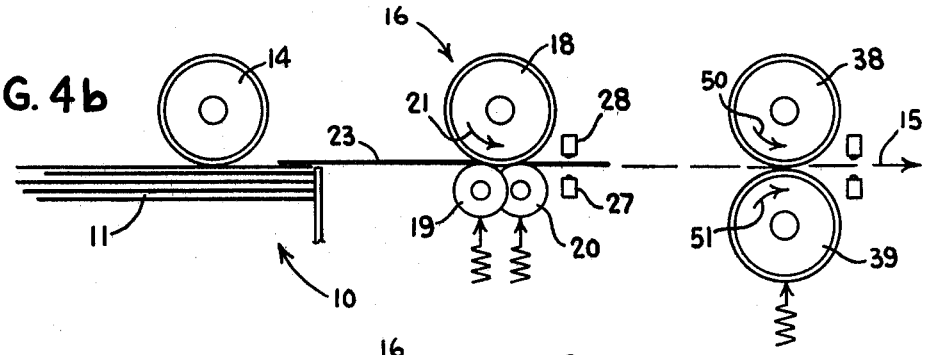

In FIG. 4*b*, the leading edge of sheet 23 has moved passed the photosensor elements 27 and 28. The photosensors have sent a signal to clutch 41 (FIG. 3) to disengage the feed roller 14. The feed roller 14 will not, therefore, drive any other sheets from stack 11. The drive roller 18 will continue to propel (arrow 21) sheet 23 toward ejection rollers 38 and 39, respectively.

Figure 4C:
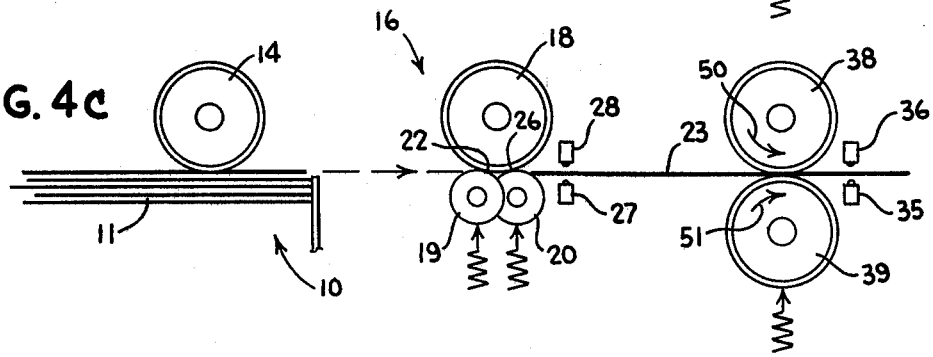

FIG. 4*c* illustrates the sheet 23 leaving bites 22 and 26 of the separating mechanism 16. The leading edge of sheet 23 has now moved through ejection rollers 38 and 39, and passed photosensors 35 and 36. These photosensors 35 and 36 have sent a signal to clutches 41 and 42 (FIG. 3) to disengage the feed roller 14 and the drive roller 18. Thus, any sheets upstream of the ejection rollers 38 and 39 will not be propelled forward. This insures that only one sheet at a time will leave the ejection rollers 38 and 39.

Figure 4D:
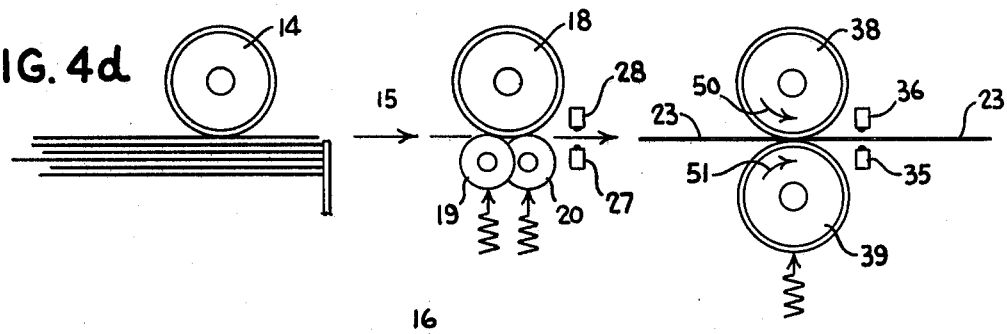

FIG. 4*d* shows the trailing edge of sheet 23 leaving the photosensors 27 and 28. This has no effect on the feed roller 14 and the drive roller 18 in the demand feed mode, because the sheet 23 is still blocking photosensors 35 and 36, which are disabling them. This mode can provide increased throughput by having the photosensor at the separator station restart the feed roller as the trailing edge of the sheet passes it to rre-establish receipt of the light beam.

Figure 4E:
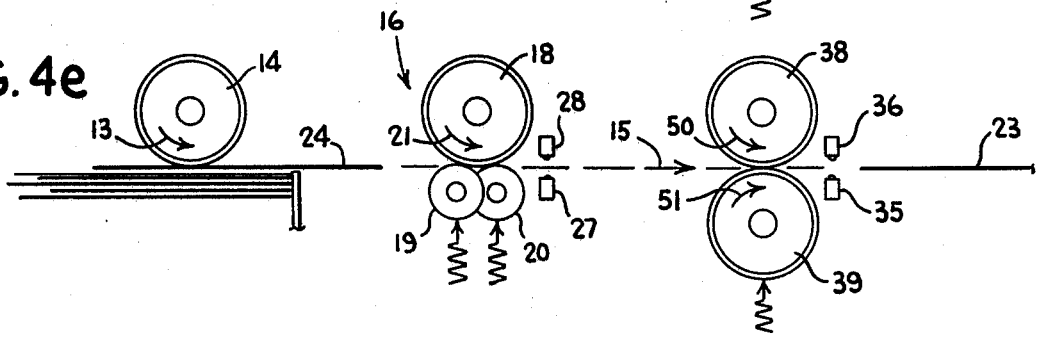

In FIG. 4*e*, the sheet 23 has now moved past sensors 35 and 36, allowing the reclutching (enabling) of the feed roller 14 and the drive roller 18. Feed roller 14 now feeds (arrow 13) a new sheet 24 towards the dual separating mechanism 16, and the cycle of sheet flow is repeated, i.e., the flow pattern shown for FIGS. 4*a* through 4*e* takes place again for the new sheet 24.

Of course, many obvious changes in the invention can be made. For example, the photosensors can be replaced by other types of proximity or limit-type switches. Driving speeds, and distances between various elements such as drive elements, photosensors, and between photosensors and drive elements may vary depending upon the mode of operation of the invention or the overall purpose of the system.

All such changes that will occur to the skilled practitioner in this art, are deemed to lie within those limits encompassed by the appended claims.

What is claimed is:

1. An automatic material separating and feeding system separating a range of inter-mixed thicknesses of sheet-like material and feeding the separated sheet-like material in seriatim to a material-handling device, said material separating feeder system comprising:

means defining a material handling feed path;

stacking means disposed at the beginning of said feed path for stacking a quantity of intermixed thicknesses of sheet-like material;

a feeding means disposed adjacent said stacking means for feeding a portion of said quantity of material towards a first separating means; and a dual separator mechanism comprising a first separating means disposed along said feed path downstream from said stacking means for separating thicker sheet-like material of said range of intermixed thicknesses, and a second separating means disposed adjacent said first separating means for separating thinner sheet-like material of said range of inter-mixed thicknesses, said second separating means having a common drive roller with said first separator means, said second separating means feeding the separated material towards a material-handling device, said second separating means working cooperatively with said first separating means such that said sheet-like material is fed to said material-handling device one sheet at a time in seriatim.

2. The automatic material separating and feeding system of claim 1, wherein each of said first and said second separating means comprise a forward rotating drive roller, and two complementary retarding members.

3. The automatic material separating and feeding system of claim 1, wherein said feeding means comprises a feed roller that frictionally engages with sheet-like material of the stacking means, and feeds said material towards the dual separating mechanism, and a feed clutch operatively connected to said feed roller for causing said feed roller to rotatively engage with, and disengage from, said sheet-like material of said stacking means.

4. The automatic material separating and feeding system of claim 3, further comprising a first sensing means disposed along said feed path adjacent said dual separating mechanism on a downstream side thereof, said first sensing means for sensing a leading edge of sheet-like material leaving said dual separating mechanism and providing a first electrical signal in response to the sensing of the leading edge, and means for coupling this first signal to said first clutch, whereby the feed roller is rotatively disengaged from feeding said sheet-like material of said stacking means.

5. The automatic material separating and feeding system of claim 4, further comprising a second clutch operatively connected to said dual separating mechanism, means for providing a demand feed signal from said material-handling device, and means for coupling the demand feed signal to said first and second clutches for causing said feeding means, and a drive roller of said dual separating mechanism to engage with said sheet-like material.

* * * * *